US008328883B2

(12) United States Patent
Tiedemann et al.

(10) Patent No.: US 8,328,883 B2
(45) Date of Patent: Dec. 11, 2012

(54) DISTILLATE FUEL COMPOSITIONS

(75) Inventors: Andrea N. Tiedemann, Hercules, CA (US); Manuch Nikanjam, Richmond, CA (US); Lawrence A. Jossens, Albany, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 150 days.

(21) Appl. No.: 12/893,622

(22) Filed: Sep. 29, 2010

(65) Prior Publication Data

US 2012/0073188 A1 Mar. 29, 2012

(51) Int. Cl.
*C10L 1/08* (2006.01)
*C10L 1/16* (2006.01)

(52) U.S. Cl. ..... 44/300; 44/450; 208/15

(58) Field of Classification Search ..... 44/300, 44/403, 301, 308

See application file for complete search history.

(56) References Cited

U.S. PATENT DOCUMENTS

| | | | | |
|---|---|---|---|---|
| 2,592,428 | A | 4/1952 | Kemp et al. | |
| 2,814,655 | A | 11/1957 | Langlois et al. | |
| 3,887,634 | A | 6/1975 | Hughes | |
| 2003/0221362 | A1 * | 12/2003 | Collier et al. | 44/363 |
| 2010/0075876 | A1 * | 3/2010 | Claydon | 508/287 |

OTHER PUBLICATIONS

J. Vardi and B.J. Kraus, "Peroxide Formation in Low Sulfure Automotive Diesel Fuels," SAE Technical Paper Series, 920826, 1992.

* cited by examiner

*Primary Examiner* — Ellen McAvoy
*Assistant Examiner* — Latosha Hines
(74) *Attorney, Agent, or Firm* — Terrence Flaherty

(57) ABSTRACT

Middle distillate fuel compositions are disclosed which comprise a major amount of a middle distillate base fuel; an olefin mixture comprising propylene oligomers having an initial boiling point of at least 165° C. and a final boiling point of no more than 325° C. as measured by ASTM D86; and at least one phenolic antioxidant. Also disclosed are methods of operating a fuel consuming system employing such compositions.

10 Claims, No Drawings

DISTILLATE FUEL COMPOSITIONS

TECHNICAL FIELD

The invention relates generally to compositions useful as middle distillate products, such as jet and diesel fuels.

BACKGROUND

Improved hydrocarbon compositions are needed to help meet the growing demand for middle distillate products, such as jet fuel and diesel fuel. Diesel fuel generally provides a higher energy efficiency in compression ignition engines than automotive gasoline provides in spark combustion engines and has a higher rate of demand growth than automotive gasoline, especially outside the U.S. Further, improved fuel compositions low in aromatics and low in sulfur content are needed to meet the ever tightening quality specifications for diesel fuel as established by industry requirements and governmental regulations.

Propylene oligomers, such as propylene tetramer and propylene pentamer, have been widely used as raw materials for many years in the manufacture of fuel and lubricating oil additives, plasticizers, and surfactants. These branched chain olefins can potentially be a useful source of middle distillate hydrocarbons that are essentially free of aromatics or sulfur. However, branched chain olefins can readily form peroxides which are very undesirable in middle distillate fuels leading to the formation of insoluble gums and other instability products. Peroxides also adversely affect certain fuel system components, such as fuel system elastomers.

It is desirable to develop middle distillate products employing branched chain olefins with improved oxidative stability.

SUMMARY OF THE INVENTION

In one aspect, the invention relates to a middle distillate fuel composition comprising a major amount of a middle distillate base fuel; an olefin mixture comprising propylene oligomers having an initial boiling point of at least 165° C. and a final boiling point of no more than 325° C. as measured by ASTM D86; and at least one phenolic antioxidant.

In another aspect, the invention relates to method of operating a fuel consuming system comprising introducing into the system a middle distillate fuel composition comprising a major amount of a middle distillate base fuel; an olefin mixture comprising propylene oligomers having an initial boiling point of at least 165° C. and a final boiling point of no more than 325° C. as measured by ASTM D86; and at least one phenolic antioxidant.

DETAILED DESCRIPTION

The following terms will be used throughout the specification and will have the following meanings unless otherwise indicated.

The term "olefin" refers to a class of unsaturated aliphatic hydrocarbons having one or more carbon-carbon double bonds, obtained by a number of processes.

The term "oligomer" refers to compositions having 2-10 mer units. A mer is defined as a unit of an oligomer that originally corresponded to the monomer(s) used in the oligomerization reaction. For example, the mer of propylene oligomer would be propylene.

The unit "ppm" means parts per million.

In one embodiment of the invention, there is provided a middle distillate fuel composition comprising a major amount of a middle distillate base fuel; an olefin mixture comprising propylene oligomers having an initial boiling point of at least 165° C. and a final boiling point of no more than 325° C. as measured by ASTM D86; and at least one phenolic antioxidant.

Middle Distillate Fuel

The middle distillate base fuel employed in the present invention may in general be any suitable liquid hydrocarbon middle distillate fuel oil. It may be organically or synthetically derived. It is suitably a diesel base fuel, for example a petroleum derived or a Fischer-Tropsch derived gas oil. The middle distillate base fuel will typically have boiling points within the usual middle distillate range of 125 to 550° C. or often 150 to 400° C. The term "distillate" means that typical fuels of this type can be generated from vapor overhead streams from distilling petroleum crude. In contrast, residual fuels cannot be generated from vapor overhead streams by distilling petroleum crude and are the non-vaporizable remaining portion.

The base fuel will typically have boiling points within the usual diesel range of 170 to 370° C., depending on grade and use. It will typically have a density from 0.75 to 1.0 g/mL, often from 0.8 to 0.86 g/mL, at 15° C. (IP 365) and a measured cetane number (ASTM D613) of from 35 to 80, more typically from 40 to 75 or 70. Its initial boiling point will suitably be in the range 150 to 230° C. and its final boiling point in the range 290 to 400° C. Its kinematic viscosity at 40° C. (ASTM D445) might suitably be from 1.5 to 4.5 cSt. However, a diesel fuel composition according to the present invention may contain fuel components with properties outside of these ranges, since the properties of an overall blend may differ, often significantly, from those of its individual constituents.

A petroleum derived gas oil may be obtained by refining and optionally (hydro)processing a crude petroleum source. It may be a single gas oil stream obtained from such a refinery process or a blend of several gas oil fractions obtained in the refinery process via different processing routes. Examples of such gas oil fractions are straight run gas oil, vacuum gas oil, gas oil as obtained in a thermal cracking process, light and heavy cycle oils as obtained in a fluid catalytic cracking unit and gas oil as obtained from a hydrocracker unit. Optionally, a petroleum derived gas oil may comprise some petroleum derived kerosene fraction. Such gas oils may be processed in a hydrodesulfurization (HDS) unit so as to reduce their sulfur content to a level suitable for inclusion in a diesel fuel composition.

The base fuel used in a composition according to the present invention may itself be or contain a Fischer-Tropsch derived fuel component, in particular a Fischer-Tropsch derived gas oil. Such fuels are known and in use in automotive diesel and other middle distillate fuel compositions. In one embodiment, the middle distillate base fuel is a non-Fischer-Tropsch derived, for example petroleum derived, base fuel.

In a fuel composition according to the present invention, the base fuel may itself comprise a mixture of two or more middle distillates, in particular diesel, fuel components of the types described above. It may be or contain a so-called "biodiesel" fuel component, e.g. a fatty acid ester, in particular a fatty acid methyl ester, or another oxygenate such as an acid, ketone or ester. Such components need not necessarily be bio-derived.

In one embodiment, the middle distillate base fuel has a maximum sulfur content of 5000 ppm. In another embodiment, the middle distillate base fuel has a maximum sulfur content of 500 ppm. In yet another embodiment, the middle distillate base fuel has a maximum sulfur content of 15 ppm.

The fuel composition will suitably contain a major amount of the middle distillate base fuel. A "major amount" means an amount greater than 50 weight percent, typically 80 weight percent or greater, more suitably 90 or 95 weight percent or greater based on the total weight of the fuel composition.

Olefin Mixture

The olefin mixture contains at least propylene oligomers having an initial boiling point of at least 165° C. and a final boiling point of no more than 325° C. as measured by ASTM D86. In one embodiment, the propylene oligomers have an initial boiling point of at least 170° C. as measured by ASTM D86. In one embodiment, the propylene oligomers have an initial boiling point of at least 175° C. as measured by ASTM D86. In one embodiment, the propylene oligomers have an initial boiling point of at least 180° C. as measured by ASTM D86.

In one embodiment, the propylene oligomers have a final boiling point of no more than 300° C. as measured by ASTM D86. In one embodiment, the propylene oligomers have a final boiling point of no more than 270° C. as measured by ASTM D86. In one embodiment, the propylene oligomers have a final boiling point of no more than 240° C. as measured by ASTM D86. In one embodiment, the propylene oligomers have a final boiling point of no more than 210° C. as measured by ASTM D86. Any combination of the foregoing initial boiling points and final boiling points for the propylene oligomers are contemplated herein. For example, in one embodiment, the propylene oligomers have an initial boiling point of at least 170° C. and a final boiling point of no more than 240° C. as measured by ASTM D86.

In one embodiment, the propylene oligomers of the present invention can contain tetramers, pentamers, or mixtures thereof. Propylene tetramer comprises carbon chains with a high degree of methyl branching and an average carbon number of 12. Generally, propylene tetramer can have a carbon number distribution between 10 to 15 carbon atoms. Propylene pentamer comprises carbon chains with a high degree of methyl branching and an average carbon number of 15. Generally, propylene pentamer can have a carbon number distribution between 14 and 18 carbon atoms. The propylene oligomers employed herein may contain any amount of low molecular weight propylene oligomer, such as propylene trimer, as long as the initial boiling point of the mixture of propylene oligomers is at least 165° C.

In one embodiment, the propylene oligomers contain a distribution of carbon atoms that comprise at least 50 weight percent of $C_{10}$ to $C_{15}$ carbon atoms; in one embodiment, the propylene oligomers contain a distribution of carbon atoms that comprise at least 60 weight percent of $C_{10}$ to $C_{15}$ carbon atoms; in one embodiment, the propylene oligomers contain a distribution of carbon atoms that comprise at least 70 weight percent of $C_{10}$ to $C_{15}$ carbon atoms; in one embodiment, the propylene oligomers contain a distribution of carbon atoms that comprise at least 80 weight percent of $C_{10}$ to $C_{15}$ carbon atoms; in one embodiment, the propylene oligomers contain a distribution of carbon atoms that comprise at least 90 weight percent of $C_{10}$ to $C_{15}$ carbon atoms.

Generally, the olefin mixture will contain a major mount of the propylene oligomers discussed hereinabove. However, as one skilled in the art will readily appreciate, the olefin mixture can contain other olefins. For example, the other olefins that can be used in the olefin mixture include linear olefins, cyclic olefins, branched olefins other than propylene oligomers such as butylene or isobutylene oligomers, arylalkylenes and the like and mixtures thereof.

Propylene oligomers can be prepared by any method known in the art. In a particularly preferred embodiment, a process for preparing the propylene oligomers that can be used in this invention employs a liquid phosphoric acid oligomerization catalyst, see, e.g., the liquid phosphoric acid-catalyzed propylene oligomerization processes disclosed in U.S. Pat. Nos. 2,592,428; 2,814,655; and 3,887,634. Propylene oligomer additives are also available from a number of commercial sources. Propylene tetramer is available, for example, from Chevron Oronite Company LLC, ExxonMobil and Texas Petrochemicals. Propylene pentamer is available, for example, from Chevron Oronite Company LLC and Texas Petrochemicals LP.

The olefin mixture in the middle distillate fuel composition disclosed herein is generally present in an amount of from 0.5 to 20 weight percent, based on the total weight of the fuel composition, and is more typically present in amount of from 1 to 10 weight percent, based on the total weight of the fuel composition.

Phenolic Antioxidant

The phenolic antioxidant disclosed herein may in general be any suitable phenolic antioxidant. Examples of suitable phenolic antioxidants include, but are not limited to, 4,4'-methylenebis(2,6-di-tert-butylphenol); 4,4'-bis(2,6-di-tert-butylphenol); 4,4'-bis(2-methyl-6-tert-butylphenol); 2,2'-methylenebis(4-methyl-6-tert-butylphenol); 4,4'-butylidenebis(3-methyl-6-tert-butylphenol); 4,4'-isopropylidenebis(2,6-di-tert-butylphenol); 2,2'-methylenebis(4-methyl-6-nonylphenol); 2,2'-isobutylidenebis(4,6-dimethylphenol); 2,2'-methylenebis(4-methyl-6-cyclohexylphenol); 2,6-di-tert-butylphenol; 2,6-di-tert-butyl-4-methylphenol; 2,6-di-tert-butyl-4-ethylphenol; 2,4-dimethyl-6-tert-butylphenol; 2,6-di-tert-α-dimethylamino-p-cresol; 2,6-di-tert-4(N,N' dimethylaminomethylphenol); branched alkyl esters of 3,5-di-tert-butyl-4-hydroxycinnamic acid; 4,4'-thiobis(2-methyl-6-tert-butylphenol); 2,2'-thiobis(4-methyl-6-tert-butylphenol); bis(3-methyl-4-hydroxy-5-tert-butylbenzyl)sulfide; and bis(3,5-di-tert-butyl-4-hydroxybenzyl)sulfide; or mixtures thereof. More typically, the phenolic antioxidant employed in the middle distillate fuel composition disclosed herein is a mixture of phenolic antioxidants.

The phenolic antioxidant in the middle distillate fuel composition disclosed herein is generally present in an amount of from 1 ppm to 500 ppm, based on the total weight of the fuel composition, and is more typically present in an amount of from 1 to 100 ppm, based on the total weight of the fuel composition, and often is present in an amount of from 1 to 50 ppm, based on the total weight of the fuel composition.

Other Additives

The middle distillate fuel compositions disclosed herein may include additional additives, such as dispersants, detergents, corrosion inhibitors, lubricity enhancers, pour point depressants, flow improvers, cetane number improvers, antistatic additives, drag reducing agents, metal deactivators, demulsifiers, dehazers, biocides, dyes, markers, and the like.

In one embodiment, the middle distillate fuel composition comprises a major amount of a middle distillate base fuel; an olefin mixture comprising propylene oligomers having an initial boiling point of at least 165° C. and a final boiling point of no more than 325° C. as measured by ASTM D86; and at least one phenolic antioxidant wherein the composition has a lubricity such as to give an HFRR wear scar diameter of no greater than 520 microns as measured by ASTM D6079. The HFRR wear scar diameter is a means of evaluating the lubricity of diesel fuels. The diesel fuel oil standard (ASTM D975) sets a maximum HFRR wear scar diameter of 520 microns for all grades of diesel fuel oils suitable for various types of diesel engines except for No. 4-D Grade where no maximum HFRR wear scar diameter is reported.

In another aspect, the invention is directed to a method of operating a fuel consuming system comprising introducing into the system a middle distillate fuel composition comprising a major amount of a middle distillate base fuel; an olefin mixture comprising propylene oligomers having an initial boiling point of at least 165° C. and a final boiling point of no more than 325° C. as measured by ASTM D86; and at least one phenolic antioxidant.

EXAMPLES

The following examples are given to illustrate the present invention. It should be understood, however, that the invention is not to be limited to the specific conditions or details described in these examples.

A propylene oligomer was obtained from Chevron Oronite Company LLC (San Ramon, Calif.). The propylene oligomer had an initial boiling point of about 170° C., a final boiling point of about 230° C. as measured by ASTM D86 and a typical carbon number distribution as set forth below in Table 1

TABLE 1

Propylene Oligomer Carbon Atom Distribution

| | Wt. % |
|---|---|
| $C_9$ | 1.9 |
| $C_{10}$ | 4.1 |
| $C_{11}$ | 7.1 |
| $C_{12}$ | 55.7 |
| $C_{13}$ | 9.7 |
| $C_{14}$ | 8.6 |
| $C_{15}$ | 12.0 |

The thermal stability, oxidative stability and storage stability of the base fuel (a Grade No. 2-D S15 as defined in ASTM D975), freshly prepared olefin mixture comprising propylene oligomers with and without a phenolic antioxidant, and fuel blends (containing the base fuel, a propylene oligomer and a phenolic antioxidant) were evaluated by standard test methods. In addition, several fuel blends was evaluated to ensure that such fuel blends meet the lubricity requirements of diesel fuel oil standard specification ASTM D975.

High temperature stability was evaluated by ASTM D6468. In this method, two 50 mL samples of filtered middle distillate fuel are heated with exposure to air at 150° C. for 1.5 and 3 hours. The samples are cooled and filtered. The average amount of filterable insoluble matter is then estimated by measuring the light reflectance of the filter pads. The results are presented in Table 2.

TABLE 2

High Temperature Stability Results (ASTM D6468)

| | Description | Amount of Anti-oxidant[1] (ppm) | Reflectance at 1.5 h | Reflectance at 3 h |
|---|---|---|---|---|
| Comp. Ex. A | S15 | 0 | >99% | >99% |
| Comp. Ex. B | Propylene oligomer | 0 | >99% | >99% |
| Comp. Ex. C | Propylene oligomer | 50 | >99% | >99% |
| Comp. Ex. D | Propylene oligomer | 100 | >99% | >99% |
| Comp. Ex. E | Propylene oligomer | 200 | >99% | >99% |
| Ex. 1 | S15 + 2% propylene oligomer | 50 | >99% | >99% |
| Ex. 2 | S15 + 8% propylene oligomer | 50 | >99% | >99% |

[1]A mixture of substituted phenols available from Nalco Company as (NALCO ® EC5208A).

The results demonstrate that middle distillate compositions containing propylene oligomers and a phenolic antioxidant do not form undesirable insoluble particulate matter.

Oxidative stability was evaluated by ASTM D3703 and the Rancimat test. ASTM D3703 is a test method for determining the hydroperoxide content of fuels. In this test, a quantity of sample is dissolved in 2,2,4-trimethylpentane and treated with an aqueous potassium iodide solution. The amount of iodine generated when the hydroperoxides present in the fuel are reduced by the potassium iodide is determined by titration with an aqueous sodium thiosulfate solution thereby providing the amount of hydroperoxide produced. Samples were kept at 65° C. for 4 weeks and measurements made at weekly intervals. Greater than 1 ppm of peroxide formation was considered significant peroxide formation. The results are set forth in Table 3.

TABLE 3

Oxidative Stability Test Results (ASTM 3703)

| | Description | Amount of Anti-oxidant[1] (ppm) | Amount of Peroxide Formation (ppm) | | | | |
|---|---|---|---|---|---|---|---|
| | | | Week 0 | Week 1 | Week 2 | Week 3 | Week 4 |
| Comp. Ex. A | S15 | 0 | <1 | <1 | <1 | 1.2 | <1 |
| Comp. Ex. B | Propylene oligomer | 0 | <1 | 17.8 | 95.9 | 114 | 154 |
| Comp. Ex. C | Propylene oligomer | 50 | <1 | <1 | <1 | 1.0 | 1.7 |
| Comp. Ex. D | Propylene oligomer | 100 | <1 | <1 | 1.1 | <1 | 1.4 |
| Comp. Ex. E | Propylene oligomer | 200 | <1 | <1 | <1 | <1 | 1.0 |
| Ex. 1 | S15 + 2% propylene oligomer | 50 | <1 | <1 | <1 | <1 | <1 |

TABLE 3-continued

| Oxidative Stability Test Results (ASTM 3703) | | | | | | | |
|---|---|---|---|---|---|---|---|
| | | Amount of Anti-oxidant[1] | Amount of Peroxide Formation (ppm) | | | | |
| | Description | (ppm) | Week 0 | Week 1 | Week 2 | Week 3 | Week 4 |
| Ex. 2 | S15 + 8% propylene oligomer | 50 | <1 | <1 | <1 | <1 | <1 |

[1]A mixture of substituted phenols available from Nalco Company as (NALCO ® EC5208A)

Another useful method for determining the oxidation stability of fuels has been found to be the so-called Rancimat method to European standard DIN EN 14112, in which an air stream is passed through the sample under controlled conditions at relatively high temperature (110° C.), and the volatile acidic addition products formed in the oxidation are collected and analyzed by conductometry. The longer the measured induction time (incubation time) until the rise in the conductivity curve, the more stable the sample. Desired values for the induction time are over 7 hours, especially over 8 hours, in particular over 10 hours, with a minimum dosage of the antioxidant used. The results are reported in Table 4 as an average of two runs.

TABLE 4

| Rancimat Oxidative Stability Test Results (DIN EN 14112) | | | |
|---|---|---|---|
| | Description | Amount of Anti-oxidant[1] (ppm) | Induction Time (hours) |
| Comp. Ex. A | S15 | 0 | >30 |
| Comp. Ex. B | Propylene oligomer | 0 | 1.2 |
| Comp. Ex. C | Propylene oligomer | 50 | 20.0 |
| Comp. Ex. D | Propylene oligomer | 100 | 28.9 |
| Comp. Ex. E | Propylene oligomer | 200 | >30 |
| Ex. 1 | S15 + 2% propylene oligomer | 50 | >30 |
| Ex. 2 | S15 + 8% propylene oligomer | 50 | >30 |

[1]A mixture of substituted phenols available from Nalco Company as (NALCO ® EC5208A)

The results of the oxidative stability tests demonstrate that the propylene oligomers are highly susceptible to oxidative degradation. Oxidative stability of the propylene oligomers is improved by the addition of a phenolic antioxidant. Middle distillate fuel blends containing propylene oligomers and a phenolic antioxidant are highly stable to oxidative degradation.

Storage stability was evaluated by ASTM D5304, ASTM D4625 and ASTM D2274. ASTM D5304 is a test method for assessing middle distillate fuel storage stability by oxygen overpressure. In this test, a 100 mL sample of filtered fuel in a borosilicate glass container is placed in preheated pressure vessel. The vessel is pressurized with oxygen to 100 psig and the pressure vessel is placed in a forced air oven at 90° C. for 16 hours. After cooling, the total amount of insoluble products in the fuel is determined gravimetrically. Results are reported as an average of two runs. ASTM D4625 is a test method for assessing middle distillate fuel storage stability at 43° C. In this test, 400 mL samples of filtered fuel are stored at 43° C. for 12 weeks in borosilicate glass containers. The samples are cooled and analyzed for filterable insoluble matter and for adherent insoluble matter. ASTM D2274 is a test method for assessing the inherent stability of middle distillate fuels under oxidizing conditions at 95° C. In this test, a 350 mL filtered fuel sample is heated at 95° C. for 16 hours while oxygen is bubbled through the sample at a rate of 3 L/h. The sample is cooled and analyzed for filterable insoluble matter and for adherent insoluble matter. The storage stability test results are reported in Table 5. In these test methods, lower values correspond to better storage stability.

TABLE 5

| Storage Stability Results | | | | | |
|---|---|---|---|---|---|
| | Descrip-tion | Amount of Anti-oxidant[1] (ppm) | ASTM D5304 $O_2$ Over-pressure (mg/100 mL) | ASTM D4625 12 Week Stability (mg/100 mL) | ASTM D2274 Ox. Stability (mg/100 mL) |
| Comp. Ex. A | S15 | 0 | 0.3 | 0.11 | 0.3 |
| Comp. Ex. B | Propylene oligomer | 0 | 3.0 | 0.09 | 0.5 |
| Ex. 1 | S15 + 2% propylene oligomer | 50 | 0.3 | 0.03 | 0.6 |
| Ex. 2 | S15 + 8% propylene oligomer | 50 | 0.4 | 0.03 | 0.5 |

[1]A mixture of substituted phenols available from Nalco Company as (NALCO ® EC5208A)

The results demonstrate that middle distillate fuel blends containing propylene oligomers and a phenolic antioxidant do not cause unacceptable fuel stability.

Fuel lubricity was evaluated by ASTM D6079. In this test, a 2 mL fuel sample is placed in a High Frequency Reciprocating Rig (HFRR) test reservoir and heated to 60° C. A test disk is submerged into the fuel and the disk is contacted with a non-rotating steel ball loaded with a 200 gram mass. The ball is rubbed against the disk at a 1 mm stroke at a set frequency and time (50 Hz for 75 minutes). The ball is removed and cleaned. The wear scar is measured by optical methods. The results are set forth in Table 6.

TABLE 6

| HFRR Wear Scar Test Results (ASTM D6079) | | | |
|---|---|---|---|
| | Description | Amount of Anti-Oxidant[1] (ppm) | Wear Scar Diameter (microns) |
| Comp. Ex. A | S15 | 0 | 367 |
| Comp. Ex. B | Propylene oligomer | 0 | 754 |
| Ex. 1 | S15 + 2% propylene oligomer | 50 | 278 |
| Ex. 2 | S15 + 8% propylene oligomer | 50 | 356 |

[1]A mixture of substituted phenols available from Nalco Company as (NALCO ® EC5208A)

Diesel fuel oil standard specification ASTM D975 requires an HFRR wear scar of no greater than 520 microns for Grade No. 2-D S15 middle distillate fuel. Propylene oligomer fails the test. In contrast, diesel fuel compositions containing propylene oligomers meet this lubricity standard.

For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained by the present invention. It is noted that, as used in this specification and the appended claims, the singular forms "a," "an," and "the," include plural references unless expressly and unequivocally limited to one referent. As used herein, the term "include" and its grammatical variants are intended to be non-limiting, such that recitation of items in a list is not to the exclusion of other like items that can be substituted or added to the listed items.

This written description uses examples to disclose the invention, including the best mode, and also to enable any person skilled in the art to make and use the invention. The patentable scope is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims. All citations referred herein are expressly incorporated herein by reference.

The invention claimed is:

1. A middle distillate fuel composition comprising (a) a major amount of a middle distillate base fuel;

(b) an olefin mixture comprising propylene oligomers having an initial boiling point of at least 165° C. and a final boiling point of no more than 325° C. as measured by ASTM D86, wherein the olefin mixture is present in an amount of from 0.5 to 20 weight percent based on the total weight of the fuel composition; and (c) at least one phenolic antioxidant.

2. The middle distillate fuel composition of claim 1 wherein the middle distillate base fuel has a maximum sulfur content of 15 ppm.

3. The middle distillate fuel composition of claim 1 wherein the olefin mixture is present in an amount of from 1 to 10 weight percent based on the total weight of the fuel composition.

4. The middle distillate fuel composition of claim 1, wherein the propylene oligomers have an initial boiling point of at least 170° C. as measured by ASTM D86.

5. The middle distillate fuel composition of claim 1, wherein the propylene oligomers have a final boiling point of no more than 300° C. as measured by ASTM D86.

6. The middle distillate fuel composition of claim 1, wherein the propylene oligomers have an initial boiling point of at least 170° C. and a final boiling point of no more than 240° C. as measured by ASTM D86.

7. The middle distillate fuel composition of claim 1, wherein the olefin mixture comprises propylene tetramers, pentamers, or mixtures thereof.

8. The middle distillate fuel composition of claim 1, wherein the propylene oligomers contain a distribution of carbon atoms that comprise at least 50 weight percent of $C_{10}$ to $C_{15}$ carbon atoms.

9. The middle distillate fuel composition of claim 1, wherein the phenolic antioxidant is present in an amount of from 1 ppm to 500 ppm based on the total weight of the fuel composition.

10. The middle distillate fuel composition of claim 1, wherein the composition has a lubricity such as to give an HFRR wear scar diameter of no greater than 520 microns as measured by ASTM D6079.

* * * * *